US007299668B1

(12) United States Patent
Lu

(10) Patent No.: US 7,299,668 B1
(45) Date of Patent: Nov. 27, 2007

(54) COMBINED CLAMP AND LOCK

(75) Inventor: Francisco Lu, Kaohsiung (TW)

(73) Assignee: Miz Engineering Ltd., Kaohsiung (TW)

( * ) Notice: Subject to any disclaimer, the term of this patent is extended or adjusted under 35 U.S.C. 154(b) by 0 days.

(21) Appl. No.: 11/583,929

(22) Filed: Oct. 20, 2006

(30) Foreign Application Priority Data

Aug. 8, 2006 (TW) ..... 95129047 A

(51) Int. Cl.
*E05B 73/00* (2006.01)
*E05B 65/00* (2006.01)

(52) U.S. Cl. ..... 70/58; 70/14; 70/57

(58) Field of Classification Search ..... 70/57, 70/58, 14; 248/551–553; 206/1.5, 308.1
See application file for complete search history.

(56) References Cited

U.S. PATENT DOCUMENTS 2,983,133 A * 5/1961 Hruby ..... 70/58
4,585,202 A * 4/1986 Parsekian ..... 248/553
5,169,114 A * 12/1992 O'Neill ..... 248/551
5,275,027 A * 1/1994 Eklof et al. ..... 70/14
5,582,044 A * 12/1996 Bolich ..... 70/58
5,692,400 A * 12/1997 Bliven et al. ..... 70/58
5,873,271 A * 2/1999 Smith ..... 70/58
6,053,756 A * 4/2000 Flanigan et al. ..... 439/315
6,183,483 B1 * 2/2001 Chang ..... 606/131
6,308,928 B1 * 10/2001 Galant ..... 248/553
6,622,532 B2 * 9/2003 Hsu ..... 70/14
2003/0029208 A1 * 2/2003 Merrem et al. ..... 70/58
2003/0164010 A1 * 9/2003 Galant ..... 70/58
2004/0261473 A1 * 12/2004 Avganim ..... 70/58
2005/0028571 A1 * 2/2005 Merrem et al. ..... 700/58
2006/0225470 A1 * 10/2006 Avganim ..... 70/58

FOREIGN PATENT DOCUMENTS

GB 2200395 A * 5/1988
GB 2200395 A * 8/1988

* cited by examiner

*Primary Examiner*—Jennifer H. Gay
*Assistant Examiner*—Alyson Merlino
(74) *Attorney, Agent, or Firm*—Davidson Berquist Jackson & Gowdey LLP

(57) ABSTRACT

A combined clamp and lock includes: a lower clamp member having a lower abutment plate, a wall projecting upwardly from the lower abutment plate, and a lock-mounting hole extending through the wall; an upper clamp member having an upper abutment plate, and at least one leg extending downwardly from the upper abutment plate and overlapping the wall; a fastening unit fastening the leg to the wall so that the lower and upper abutment plates define a clamping space therebetween; and a lock extending through the lock-mounting hole. A notebook computer may be prevented from being opened when clamped within the clamping space and locked by the lock.

7 Claims, 5 Drawing Sheets

COMBINED CLAMP AND LOCK

CROSS-REFERENCE TO RELATED APPLICATION

This application claims priority of Taiwanese Patent Application No. 95129047, filed on Aug. 8, 2006.

BACKGROUND OF THE INVENTION

1. Field of the Invention

The invention relates to a clamp, more particularly to a clamp used in combination with a lock to clamp and lock an article, such as a notebook computer.

2. Description of the Related Art

With the development of improved multimedia storages and displays and the development of wireless networking, the so-called notebook or laptop computer has become increasingly popular. However, the portability of the notebook computer gives rise to concerns that the notebook computer is a tempting target for thieves. In order to deter thieves, a security cable may be attached to the notebook computer. Generally, the security cable has one end provided with a loop to be fastened to a fixed structure, such as a leg of a desk, and another end provided with a computer security lock. Examples of such security cables and security locks are disclosed in R.O.C. Patent No. M284925 and R.O.C. Patent Publication No. 422266.

Although the aforesaid security cables and security locks can prevent a notebook computer from being stolen from where the computer is locked, they cannot deter a thief from opening the notebook computer and stealing information stored in the notebook computer. Therefore, there is a need to develop a clamp device for preventing a notebook computer from being opened undesirably.

SUMMARY OF THE INVENTION

Therefore, an object of the present invention is to provide a combined clamp and lock by which an openable article may be clamped and prevented from being opened while being locked against movements to prevent theft.

According to one aspect of the present invention, a clamp to be used in combination with a lock for locking an article comprises: a lower clamp member having a lower abutment plate, a wall projecting upwardly from the lower abutment plate, and a lock-mounting hole extending through the wall and adapted to receive the lock; an upper clamp member having an upper abutment plate, and at least one leg extending downwardly from the upper abutment plate and overlapping the wall; and a fastening unit fastening the leg to the wall so that the lower and upper abutment plates define therebetween a clamping space.

According to another aspect of the present invention, a combined clamp and lock comprises: a lower clamp member having a lower abutment plate, a wall projecting upwardly from the lower abutment plate, and a lock-mounting hole extending through the wall; an upper clamp member having an upper abutment plate, and at least one leg extending downwardly from the upper abutment plate and overlapping the wall; a fastening unit fastening the leg to the wall so that the lower and upper abutment plates define therebetween a clamping space; and a lock extending through the lock-mounting hole and projecting into the clamping space.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Referring to FIGS. 1 to 4, there is shown a combined clamp and lock embodying the present invention. The combined clamp and lock includes a clamp 2 for clamping an article, such as a notebook computer 5, and includes a clamp assembly 3, and a fastening unit 4. The clamp 2 is combined with a lock, which may be any conventional lock that is mountable on the clamp 2.

Figure 2:
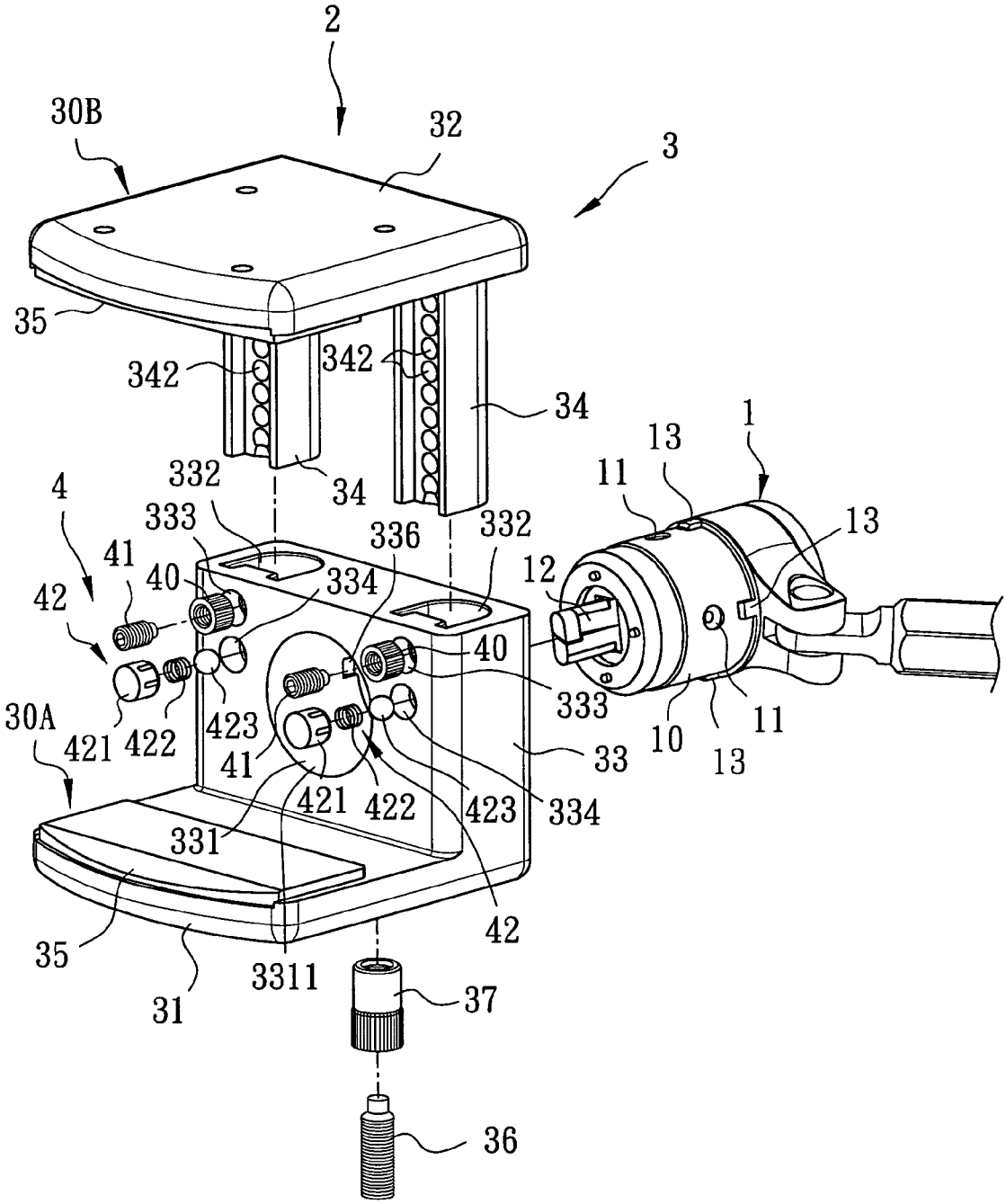
FIG. 2 is an exploded view of the combined clamp and lock.

In this embodiment, the lock is a computer lock 1 that has a housing body 10, four angularly spaced apart blind holes 11 formed in an outer periphery of the housing body 10, and four angularly spaced apart protrusions 13 (only three protrusions 13 are shown in FIG. 2) which are aligned axially with the respective blind holes 11. The computer lock 1 further has a conventional hook assembly 12 for engaging a slot 51 in the notebook computer 5. A security cable 16 is connected to the computer lock 1 and is fastened to a stationary post 17.

Figure 3:
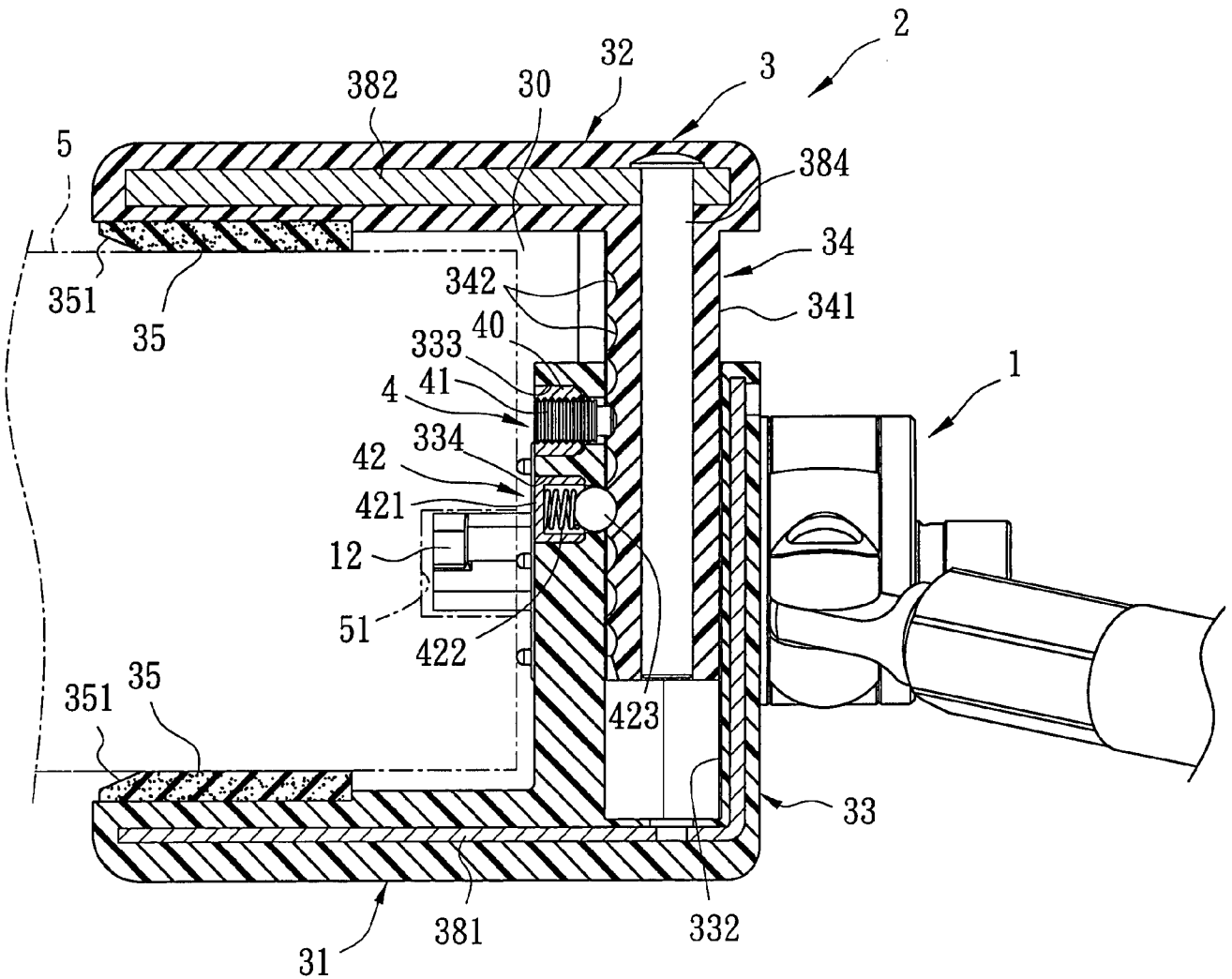
FIG. 3 is a sectional view of the combined clamp and lock.

The clamp assembly 3 of the clamp 2 includes two substantially L-shaped lower and upper clamp members 30A and 30B. The lower clamp member 30A has a lower abutment plate 31 adapted to abut against a bottom side of the notebook computer 5, and a wall 33 projecting upwardly from the lower abutment plate 31. The upper clamp member 30B has an upper abutment plate 32 adapted to abut against a top side of the notebook computer 5, and a pair of spaced apart legs 34 projecting downwardly from the upper abutment plate 32. The legs 34 extend from the upper abutment plate 32 to the lower abutment plate 31 and overlap the wall 33 of the lower abutment plate 31. Specifically, the legs 34 are inserted into the wall 33 and are fastened to the wall 33 by the fastening unit 4. The lower and upper abutment plates 31, 32 cooperatively define a clamping space 30 to receive a portion of the notebook computer 5 as shown in FIG. 3.

Each of the lower and upper clamp members 30A, 30B is formed as a composite structure containing plastic material molded over a reinforcing metallic core. In particular, the lower clamp member 30A has an L-shaped metallic core 381 embedded in the lower abutment plate 31 and the wall 33, and the upper clamp member 30B has metallic cores 382 and 384 embedded in the upper abutment plate 32 and the legs 34, respectively. However, while the aforesaid composite structures are employed for the lower and upper clamp members 30A, 30B, the present invention should not be limited thereto. The lower and upper clamp members 30A, 30B may be entirely made of metal without using any plastic material. Preferably, a protective pad 35 made of a foamed material is disposed over an inner surface of each of the lower and upper abutment plates 31, 32 in this embodiment.

The lower clamp member 30A is provided with a lock-mounting hole 331 that extends through inner and outer sides of the wall 33 to receive the computer lock 1. The inner side of the wall 33 faces the clamping space 30. The lower clamp member 30A further has a pair of insert holes 332 which are spaced apart from each other and which extend downwardly from the top of the wall 33 to the lower abutment plate 31. The legs 34 are inserted movably and releaseably into the respective insert holes 332.

The lower clamp member 30A further includes a pair of fastener-receiving holes 333 and a pair of fastener-aligning holes 334. The fastener-receiving holes 333 and the fastener-aligning holes 334 are all formed in the wall 33 and each have an outer end opening at the inner side of the wall 33 and an inner end connected to one of the insert holes 332. Each of the fastener-aligning holes 334 is aligned vertically with one of the fastener-receiving holes 333.

The lower clamp member 30A further includes a fixing hole 335 (see FIG. 4) formed in the wall 33 and extending from the lower abutment plate 31 to the lock-mounting hole 331 in the wall 33, and four angularly spaced apart lock-aligning notches 336 formed adjacent to the outer side of the wall 33 and in an inner wall 3311 that confines the lock-mounting hole 331. The lock-aligning notches 336 are alignable with the protrusions 13 of the computer lock 1 when the computer lock 1 is inserted into the lock-mounting hole 331.

Each leg 34 is inserted into one of the insert holes 332 and has a plurality of engaging slots 342 that are spaced apart longitudinally of the leg 34 at equal intervals.

The fastening unit 4 includes a pair of internally threaded tubes 40 fitted respectively in the fastener-receiving holes 333, and a pair of fasteners or screws 41 inserted threadedly and respectively into the tubes 40. Each fastener 41 has an inner end extending into one of the insert holes 332 to engage one of the engaging slots 342 in one of the legs 34 so that end leg 34 is fastened to the wall 33.

The clamp assembly 3 further has two aligning units 42 to align the fasteners 41 with the respective engaging slots 342 of the legs 34. Each aligning unit 42 includes a resilient aligning member 423 that is loaded with a spring 422 and that is disposed within one of the fastener-aligning holes 334 in the wall 33. Each resilient aligning member 423 together with the corresponding spring 422 is retained within the corresponding fastener-aligning hole 334 by a retaining cap 421. The resilient aligning members 423 are preferably formed as balls and are urged by the springs 422 to project into the respective insert holes 332. The positions of the fastener-aligning holes 334 or the aligning members 423 are arranged in such a manner that, when each fastener-aligning hole 334 or each aligning member 423 is aligned with one of the engaging slots 342 in the respective leg 34, the adjacent fastener-receiving hole 333 is aligned with the other engaging slot 342 in the same leg 34.

The lower clamp member 30A further has a fixing member 36 disposed within the fixing hole 335 of the wall 33 to fix the computer lock 1 to the wall 33. The fixing member 36 is threadedly inserted into a metallic bushing 37 which is threaded internally and which is fitted in the fixing hole 335. The fixing member 36 has an inner end extending into the lock-mounting hole 331 to engage one of the blind holes 11 in the computer lock 1. In this embodiment, the fixing member 36 is a screw fastener. While four blind holes 11 are provided in the computer lock 1, it is contemplated that one blind hole 11 could be used according to the present invention.

Referring back to FIGS. 2 and 4, the lock-aligning notches 336 are spaced apart at equal angular distances, and one of the lock-aligning notches 336 is aligned axially with the fixing hole 335. To mount the computer lock 1 in the lock-mounting hole 331 in the wall 33, the lock housing 10 must be aligned properly with the fixing hole 335 or the fixing member 36. To avoid misalignment, the four protrusions 13 on the housing body 10 must be inserted into the respective lock-aligning notches 336 formed in the inner wall 3311 confining the lock-mounting hole 331 when the computer lock 1 is inserted into the lock-mounting hole 331. As such, one of the blind holes 11 of the lock housing 10 is aligned with the fixing hole 335 and the fixing member 36. When the fixing member 36 is tightened, the inner end of the fixing member 36 projects into the aligned one of the blind holes 11, thereby fixing the computer lock 1 to the wall 33.

Figure 1:
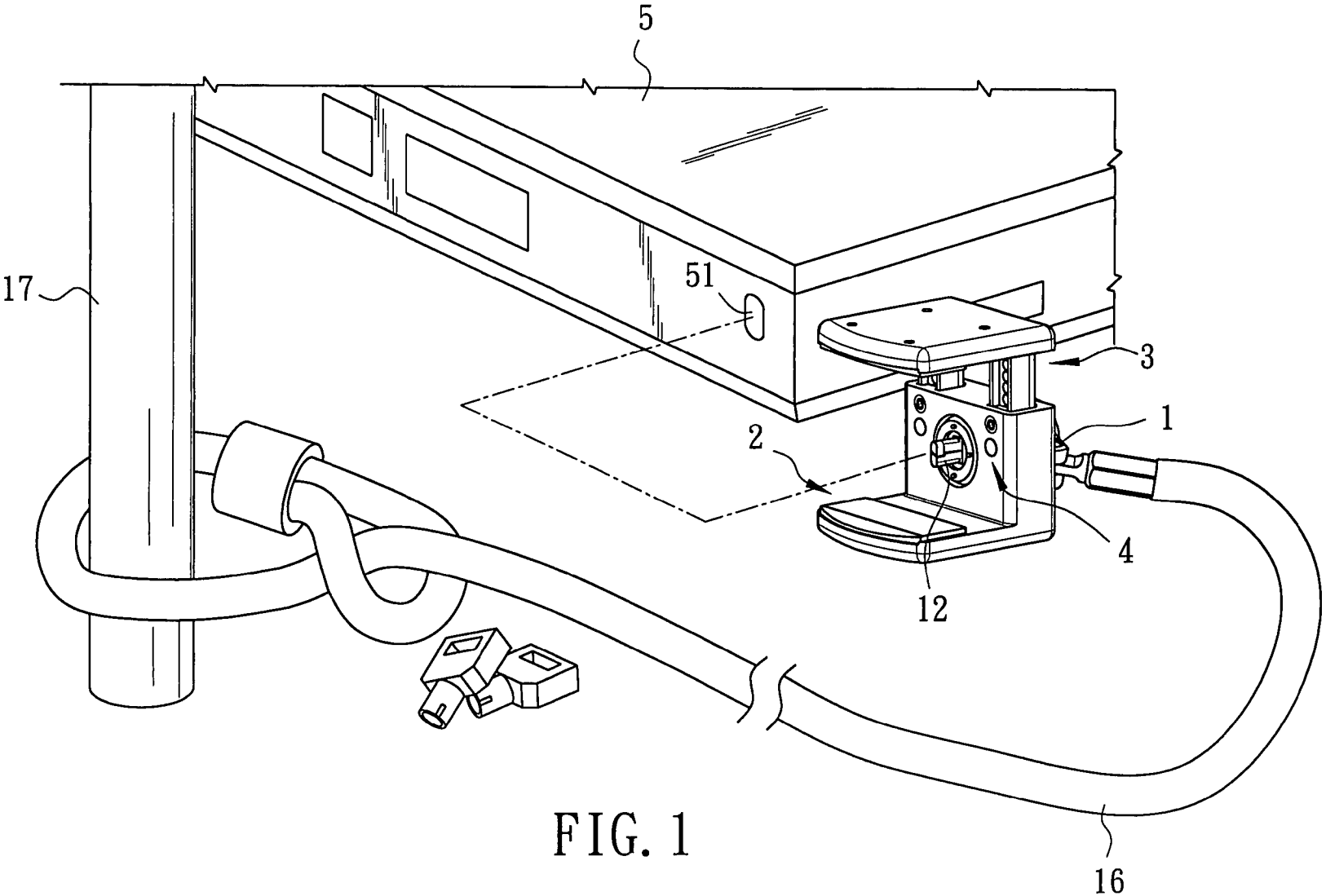
FIG. 1 is a perspective view showing a notebook computer locked and clamped by a combined clamp and lock embodying the present invention.
Figure 4:
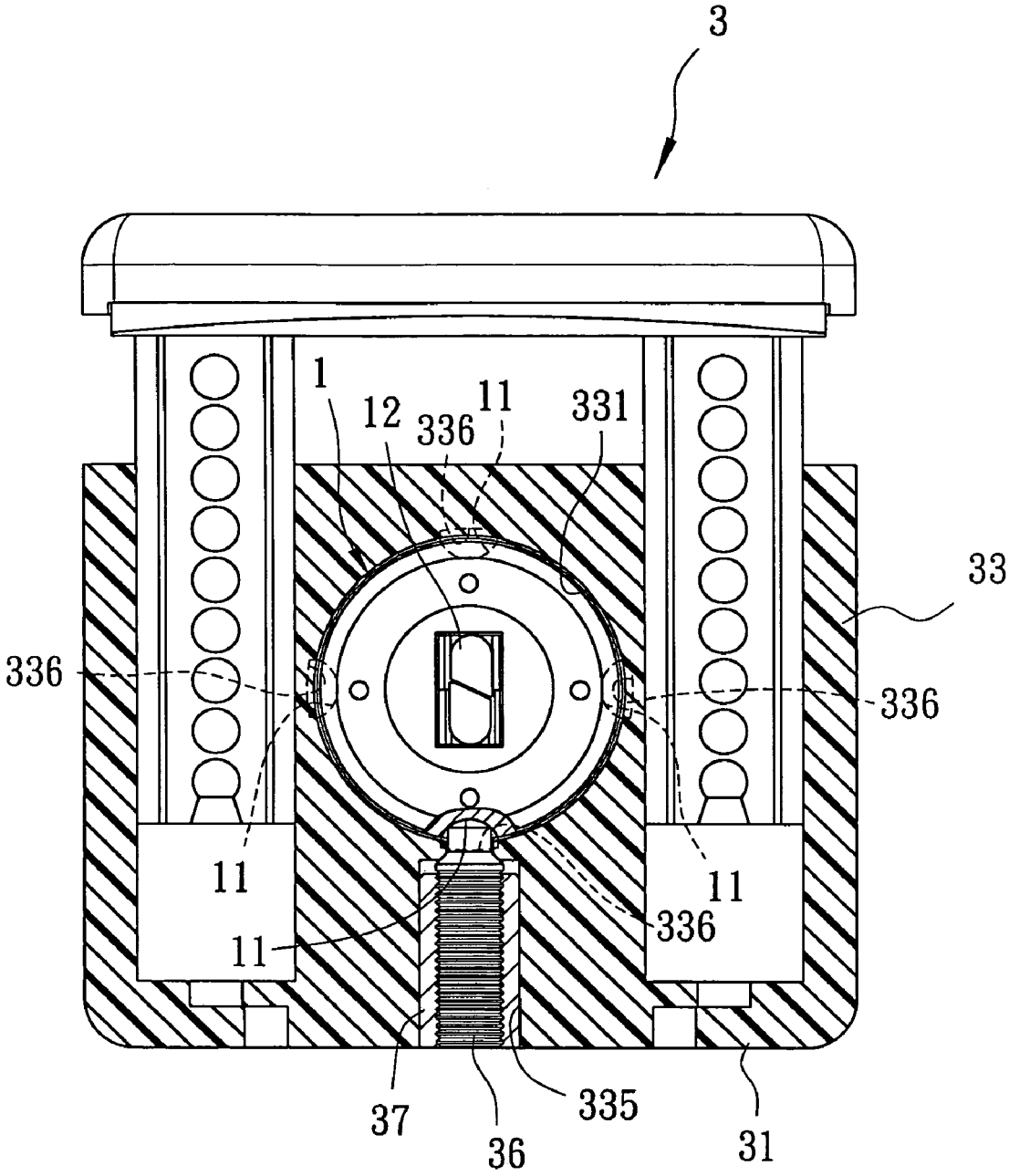
FIG. 4 is another sectional view of the combined clamp and lock.
Figure 5:
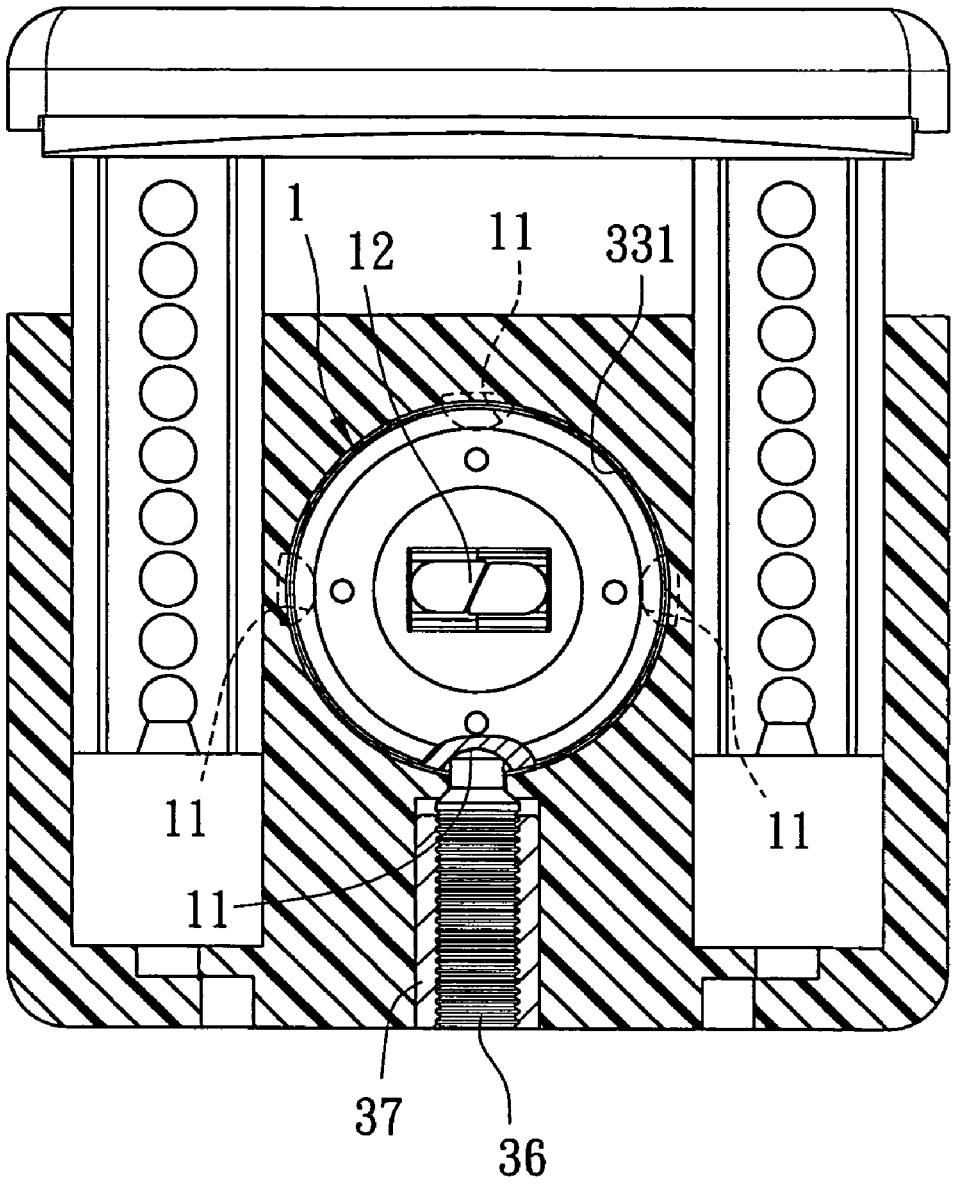
FIG. 5 is the same view as FIG. 4 but showing that the lock has been turned to change its position.

In FIG. 4, the hook assembly 12 extends vertically so that the hook assembly 12 can interlock with a vertical slot 51 of the notebook computer 5 shown in FIG. 1. The position of the hook assembly 12 may be changed by loosening the fixing member 36 and by turning the computer lock 1 by an angle of 90 degree so that the fixing member 36 engages the other one of the blind holes 11. In FIG. 5, the hook assembly 12 is in a horizontal extending position and may be used to interlock with a horizontal slot in a notebook computer (not shown).

Referring once again to FIGS. 2 and 3, the height of the clamping space 30 between the lower and upper abutment plates 31, 32 may be adjusted to conform to the height of the notebook computer 5 by moving and adjusting the positions of the legs 34 relative to the wall 33. To this end, the legs 34 may be released from the wall 33 by loosening and disengaging the fasteners 41 from the respective engaging slots 342. When the legs 34 move relative to the wall 33, the legs 34 move past the respective fastener-receiving holes 333 and the respective fastener-aligning holes 334. Because the aligning members 423 in the fastener-aligning holes 334 are resilient and in sliding contact with the respective legs 34, the aligning members 423 can extend easily and resiliently into the engaging slots 342 one after the other for self-alignment. Furthermore, because of each fastener-receiving hole 333 can be aligned with one of the engaging slots 342 in the respective leg 34 whenever the adjacent fastener-aligning hole 334 is aligned with the other engaging slot 342 in the same leg 34, the fasteners 41 in the fastener-receiving holes can be aligned easily with the respective engaging slots 342 through the alignment of the aligning member 423 with the respective engaging slots 342.

When the clamping space 30 is adjusted to a desired height and when the fasteners 41 are aligned with the respective engaging slots 342 in the legs 34, the fasteners 41 may be tightened again to engage the respective engaging slots 342, thereby fixing the legs 34 to the wall 33 and clamping the notebook computer 5 with the lower and upper abutment plates 31, 32. When the computer lock 1 is placed in a locking position thereof, the hook assembly 12 extends into and engages the slot 51 in the notebook computer 5 in a conventional manner. As such, the notebook computer 5 can be prevented from either being moved away from the stationary post 17 or being opened undesirably.

Referring back to FIG. 3, in order to facilitate insertion of the notebook computer 5 into the clamping space 30, the protective pads 35 disposed on the lower and upper abutment plates 31 and 32 are provided with guide surfaces 351 at outer ends thereof. The guide surfaces 351 are inclined so that the distance between the protective pads 35 are enlarged at an outer end of the clamping space 30, thereby preventing the protective pads 35 from interfering entry of the notebook computer 5 into the clamping space 30.

As described above, the computer lock 1 combined with the clamp 2 can lock the notebook computer 5 against opening movements and prevent theft of important information stored in the notebook computer 5. Furthermore, because the wall 33, and the lower and upper abutment plates 31, 32 provide shielding to the hook assembly 12 of the computer lock 1, which engages the slot 51 in the notebook computer 5, it is not easy for a thief to destroy the computer lock 1. Moreover, due to the presence of the protrusions 13 on the computer lock 1 and the aligning notches 336 in the wall 33, misalignment of the clamp lock 1 with the clamp 2 can be avoided during attachment of the computer lock 1 to the clamp 2.

While the present invention has been described in connection with what is considered the most practical and preferred embodiment, it is understood that this invention is not limited to the disclosed embodiment but is intended to cover various arrangement included within the spirit and scope of the broadest interpretation so as to encompass all such modifications and equivalent arrangements.

I claim:

1. A clamp to be used in combination with a lock for locking an article, comprising:

a lower clamp member having a lower abutment plate, a wall projecting upwardly from said lower abutment plate, and a lock-mounting hole extending through said wall and adapted to receive the lock;

an upper clamp member having an upper abutment plate, and at least one leg extending downwardly from said upper abutment plate and overlapping said wall; and a fastening unit fastening said leg to said wall so that said lower and upper abutment plates define a clamping space therebetween, wherein said lower clamp member further has at least one insert hole disposed in said wall, said leg being movably inserted into said insert hole, said wall having an inner side facing said clamping space and an outer side opposite to said inner side, said lock-mounting hole extending through said inner and outer sides, and wherein said fastening unit includes at least one fastener-receiving hole formed in said wall and having one end extending through said inner side and another end connected to said insert hole, and a fastener extending into said insert hole through said fastener-receiving hole to engage said leg.

2. The clamp as claimed in claim 1, wherein a pair of said insert holes are spaced apart in said wall, a pair of said legs are inserted respectively into said insert holes from said upper abutment plate, and said lock-mounting hole is disposed between said insert holes.

3. The clamp as claimed in claim 1, wherein said leg has a plurality of spaced apart engaging slots, said fastener extending through said fastener-receiving hole and selectively engaging one of said engaging slots.

4. The clamp as claimed in claim 3, further comprising an aligning element to align said fastener-receiving hole with one of said engaging slots, said aligning element being disposed in said wall and resiliently projecting into one of said engaging slots, said fastener-receiving hole being aligned with one of said engaging slots when said aligning element is aligned with the other one of said engaging slots.

5. A combined clamp and lock, comprising:

a lower clamp member having a lower abutment plate, a wall projecting upwardly from said lower abutment plate, and a lock-mounting hole extending through said wall;

an upper clamp member having an upper abutment plate, and at least one leg extending downwardly from said upper abutment plate and overlapping said wall;

a fastening unit fastening said leg to said wall so that said lower and upper abutment plates define a clamping space; and a lock having a housing body extending through said lock-mounting hole and projecting into said clamping space therebetween, wherein said housing body has an outer peripheral wall confronting an inner wall that confines said lock-mounting hole, and at least one blind hole formed in said outer peripheral wall, said lower clamp member further having a fixing member disposed in said lower clamp member and projecting into said blind hole to fix said housing body to said lower clamp member.

6. The combined clamp and lock as claimed in claim 5, wherein said lower clamp member further has at least one insert hole disposed in said wall, said leg being movably inserted into said insert hole, said wall having an inner side facing said clamping space and an outer side opposite to said inner side, said lock-mounting hole extending through said inner and outer sides, said lower clamp member further including a fixing hole extending from said lower abutment plate to said wall, said fixing member being fitted in said fixing hole and having an inner end engaging said blind hole.

7. The combined clamp and lock as claimed in claim 5, wherein a plurality of said blind holes are angularly spaced apart in said outer peripheral wall, said housing body further having a plurality of angularly spaced apart protrusions projecting from said outer peripheral wall and aligned respectively with said blind holes, said wall further having a plurality of angularly spaced apart aligning notches formed in said inner wall of said lock-mounting hole, said fixing hole being aligned with one of said blind holes when said protrusions extend into said aligning notches, respectively.

* * * * *